United States Patent [19]

Mitchell et al.

[11] 4,108,645

[45] Aug. 22, 1978

[54] PREPARATION OF RARE EARTH AND OTHER METAL ALLOYS CONTAINING ALUMINUM AND SILICON

[75] Inventors: Alec Mitchell, West Vancouver, Canada; James R. Goldsmith, Pittsburgh, Pa.; J. Malcolm Gray, Stamford, Conn.

[73] Assignee: Molycorp, Inc., White Plains, N.Y.

[21] Appl. No.: 753,867

[22] Filed: Dec. 23, 1976

[51] Int. Cl.[2] ..... C22C 21/04

[52] U.S. Cl. ..... 75/135; 75/134 S; 75/148; 75/174; 75/175.5; 75/177

[58] Field of Search ..... 75/68 R, 135, 148, 152, 75/134 S, 174, 175.5, 177

[56] References Cited

U.S. PATENT DOCUMENTS 3,440,040 4/1969 Kallenbach et al. ..... 75/134 S

FOREIGN PATENT DOCUMENTS 165,901 1/1963 U.S.S.R. ..... 75/152

*Primary Examiner*—M. J. Andrews

*Attorney, Agent, or Firm*—Sheridan, Ross, Fields & McIntosh

[57] ABSTRACT

A method for making an alloy of aluminum and silicon with rare earth metals and metals of Groups 4b, 5b and 6b of the Periodic Table in which the flux system $CaF_2$-$CaO$-$Al_2O_3$ is used as a solvent to provide a reactive medium for the reactions through which alloys are formed, the method comprising reducing the oxides of the alloying metals with aluminum in the presence of silicon in the flux maintained liquid at a temperature between about 1250° C – 1600° C while maintaining the flux basic to suppress the activity of $Al_2O_3$ and forming the alloys in the flux from the reduced metals.

32 Claims, No Drawings

PREPARATION OF RARE EARTH AND OTHER METAL ALLOYS CONTAINING ALUMINUM AND SILICON

BACKGROUND OF THE INVENTION

The invention lies in the field of methods for making metal alloys used in making steel and other ferrous alloys.

The advantages of alloying rare earth metals and other metals with steel and other ferrous alloys to impart desirable properties thereto are well known. Typical steel-making processes utilizing rare earth metals, for example, are illustrated by those disclosed in U.S. Pat. Nos. 2,683,661, 2,683,662 and 2,683,663. Representative alloys are disclosed in U.S. Pat. Nos. 3,250,609 and 3,295,963.

It has been the practice in making the rare earth metal alloys to use metal-silicon alloys as the reducing agents, typically, calcium silicide. Representative methods are discussed in U.S. Pat. Nos. 3,250,609, 3,256,087, 3,295,963 and 3,537,884.

In the prior art methods utilizing calcium-silicon alloys for making rare earth metal alloys as illustrated by some of the cited patents, the method is ordinarily begun by making a melt of calcium silicide, followed by addition of rare earth metal oxides to make the final alloy. Also, CaSi can be mixed with the oxides and the mixture heated to molten state to form the rare earth silicide. Although the use of calcium-silicon alloys as reducing agents in the manufacture of rare earth metal alloys has been successful, the procedure is subject to improvement. First of all, the high cost of the commercial calcium-silicon alloy is a disadvantage. Further, calcium-silicon alloys attack the refractory materials in the induction furnace in which the metals are made. Also, the source of supply for calcium-silicon alloys is limited at times so that the alloys are not always readily available. Further, metallurgically the calcium-silicon alloy contains too high a silicon content, so to use sufficient alloy to supply enough calcium to reduce the rare earths results in a high silicon-rare earth alloy which is not always desirable. Substitution of a less expensive reducing agent for the calcium-silicide is a desirable objective. An area of improvement resides in improving the recovery of the rare earth metal from its oxide and obtaining a final alloy having a higher percentage of the rare earth metal. The presence of some calcium and a low percentage of silicon is also preferred for some customer applications.

As is well known, the metals columbium, titanium and zirconium are useful alloying metals for steel to impart desired properties ot it. Titanium is ordinarily added as ferrotitanium; however, it is a difficult alloy to make. Titanium is available at times in the form of scrap, but when it is not readily available the price rises and the industry reverts to the use of ferrotitanium. The above is also true in part for columbium and zirconium. One disadvantage of the prior art practice of using alloys of titanium and zirconium for addition to steel is that there is no procedure available for making the alloys directly from ore concentrates or raw materials.

Accordingly, it is a principal object of this invention to provide a method for producing rare earth metal alloys which avoids the use of calcium-silicon alloys, gives a high recovery of the rare earth metal from the oxide, provides a final alloy having a higher percentage of rare earth metal, contains a low silicon content, and some calcium and aluminum.

It is also an object of this invention to provide a method for making alloys of ferrocolumbium, ferrotitanium and ferrozirconium, alloys used in the past for alloying these latter two metals with steel.

It is a further object of this invention to provide a method for making alloys of columbium, titanium and zirconium for use in steel making directly from the ore concentrates of these metals.

SUMMARY OF THE INVENTION

A method for making an alloy of rare earth metals and other alloying metals containing aluminum and silicon in which the system $CaF_2$-CaO-$Al_2O_3$ is used as a solvent to provide a reactive medium for the reactions through which the alloys are formed, the method comprising making a calcium oxide-calcium fluoride flux, dissolving at least one compound of the alloying metal in the flux, adding aluminum oxide to form the system $CaF_2$-CaO-$Al_2O_3$ and supply aluminum as a reducing agent, and adding silicon as a sink for the alloying metal to produce an alloy of the alloying metal, aluminum and silicon. In order to maintain the flux liquid at a minimum temperature, the addition of aluminum is controlled to provide a composition of the flux mixture which is liquid at a preferred temperature in the neighborhood of 1400° C. The alkalinity of the system is controlled in order to suppress the reaction of $Al_2O_3$ with the principal alloying metal oxides. Important features of the flux composition are that its low melting point provides maximum thermochemical advantage, it readily dissolves $Al_2O_3$ and maintains it at a low chemical potential, and by maintaining the final $Al_2O_3$/CaO ratio as high as permitted by the two above conditions, the flux composition also maintains the chemical potential of the alloying metal compounds as high as possible, thus enhancing the reaction thermochemistry.

The invention is based in part, at least, on the fundamental discovery related to the favorable thermochemistry in these systems that $Al_2O_3$ behaves as an acidic oxide with respect to CaO while $Re_2O_3$ behaves as a base in $CaF_2$-base fluxes. Hence, in a highly basic system, the activity of $Al_2O_3$ is depressed while that of $Re_2O_3$ remains high. The chemical sequences on which the process of the invention is based are designed to make use of this fact.

DESCRIPTION OF THE PREFERRED EMBODIMENT

The term "alloying metal" as used herein refers to the principal metal alloying with aluminum and silicon and includes rare earth metals as defined hereinafter and metals of Groups 4b, 5b, and 6b of the Periodic Table.

The operativeness of the invention is based on the provision of a relatively low temperature, highly basic, liquid flux, which is a good solvent for $Al_2O_3$, the alloying metals, and the formed alloys. The problem of providing such a flux is related to the phase relationships of the components of the flux mixture. For example, it was found that a flux composition of approximately 50 weight percent $CaF_2$ and 50 weight percent CaO has a melting temperature of less than 1400° C, and will dissolve large quantities of $Re_2O_3$, for example, at that temperature. The flexibility of the system is illustrated by the fact that as the reaction proceeds, dilution by $Al_2O_3$ is permissable to a composition of 40 weight percent $Al_2O_3$ plus 30 weight CaO plus 30 weight percent $CaF_2$ without moving above a 1400° C liquidus line.

The present invention is based, in part, on the discovery that the percentage composition of the system $CaF_2$-CaO-$Al_2O_3$ can be adjusted so that it is liquid at relatively low temperatures, i.e., in the neighborhood of 1400° C, along with the discovery that the percentage composition of the liquid flux can be adjusted at these temperatures to provide a suitable solvent which fulfills the chemical and thermal requirements of the chemical reactions involved for the formation of the alloys of this invention at low liquidus temperatures. A feature of the invention is the adjustment of the liquidus temperature of the system within the range of about 1250° C–1600° C by regulating the $Al_2O_3$ content of the system.

The $CaF_2$-CaO-$Al_2O_3$ system has been found useful in many metallurgical and ceramic processes, other than the present process, as discussed in the article entitled "The System $CaF_2$-CaO-$Al_2O_3$ under One-Third Atmosphere of Helium," by Ralph N. Hafziger; "High Temperature Science," pp. 414–422, 1973. The system was used in these processes to remove phosphorus and sulfur from the steel rather than as a solvent medium for alloying metals with silicon, and aluminum derived from $Al_2O_3$. German Patent No. 1,131,417, as discussed in U.S. Pat. Nos. 3,440,040 and 3,440,041, discloses the use of a $CaF_2$-CaO liquid flux mixture to reduce rare earth metal oxides in the presence of silicon to make rare earth metal-silicon alloys; however, the system does not include aluminum as a reducing agent and, accordingly, the problem of suppressing the activity of $Al_2O_3$. Russian Patent No. 165901 discloses a method for making rare earth metal alloys with silicon and aluminum by dissolving the reactants in a flux of lime and fluorspar and conducting the reactions at a temperature "not below 1800° C." There is no procedure disclosed for the critical suppression of $Al_2O_3$ activity to obtain acceptable metal recoveries or of the effectiveness of performing the alloying reactions at much lower temperatures where entirely different chemical and thermodynamic factors are involved to provide optimum equilibrium conditions for the basic reactions for producing high metal recoveries.

It is important in the interest of economy and metal recovery to perform the reduction and alloying reactions of the present invention at the minimum desirable liquidus temperature. For example, this was found to be about 1371° C for a flux mixture of about 55% rare earth metal, 25% silicon, 15% aluminum, and 5% calcium, percents being by weight percents. The liquidus flux temperature must, of course, be above the melting point of all of the alloying metals present and the resulting alloys so that reference herein and in the claims to the liquids flux temperature or the temperature at which the flux is liquid includes this condition.

It was found that if the activity of $Al_2O_3$ in this system is not suppressed, it will react with the metal oxides present to result in loss of recovery of the metals as alloys. It was also found that a basic flux will depress the activity of $Al_2O_3$ but will not depress the activity of the rare earth metal and other alloying metal except through dilution only. A basic flux is therefore necessary to reduce the chemical activity of $Al_2O_3$ while not chemically affecting the activity of $Re_2O_3$.

Investigation showed that an excess of CaO in the flux is important to maintain a basic flux to reduce the $Al_2O_3$ activity with the metal oxides present ($Al_2O_3$ acting as an acid in this case). It was discovered that $Al_2O_3$ activity in the system is at a minimum at its highest basicity. Accordingly, it is a feature of the invention that the alkalinity of the flux can be adjusted by regulating the CaO content thereof.

It is important for the success of the method of the invention that the activity of the $Al_2O_3$ with the metal oxides present be suppressed so that the reaction of the metal oxides as illustrated by the equation $Re_2O_3 + 2Al \rightarrow 2Re + Al_2O_3$ goes to completion. Lower activity of the $Al_2O_3$ in the flux is further accomplished by careful control of the content in the liquid flux mixture of $Al_2O_3$ produced by the above type chemical reaction. The weight percent of $Al_2O_3$ in the flux should not exceed about 42% as the alloying reactions become less efficient as the $Al_2O_3$ content (activity) increases and will stop at some point. At high percentages of $Al_2O_3$, adjustment of the alkalinity to the required value becomes impractical. The method can be practiced effectively at a percentage range of $Al_2O_3$ of about 10–42 percent, with a preferred percentage being in the neighborhood of about 20%.

Silicon is added simultaneously with the aluminum and does not enter into the reaction, but acts as a "sponge" or "sink" for the newly-reduced alloying or principal metal by forming an alloy with it immediately after reduction when the metals are in the liquid state. Accordingly, the oxides are reduced by aluminum as the reducing agent. It was found that the metal oxides, for example, cannot be most effectively reduced from the liquid flux mixture when added in the presence of silicon or aluminum alone because the standard state thermochemistry is unfavorable. For example, tests showed that in $Re_2O_3$-silicon mixtures even under the most favorable conditions of unit activity, there was only a slight reduction of the oxide by silicon. The same applies to the other metal oxides. However, it was found that the metal oxides can be reduced in the system by the simultaneous addition of aluminum and silicon, the latter acting as a sink for the alloying metals, and by using CaO from the $CaF_2$ flux mixture to maintain alkalinity and to thus reduce $Al_2O_3$ activity due to interaction of CaO and $Al_2O_3$ without affecting the activity of $Re_2O_3$ except through dilution.

It is believed that the reason for the effect produced by using silicon as a sink may be due to interactions between silicon and rare earth metals under the outlined conditions with the formation of Re-Si compounds or alloys. It is further advantageous to have silicon metal present as it is necessary in the product alloy to ensure that the melting point of the alloy is compatible with the normal temperatures encountered in handling molten steel in the foundry.

The system $CaF_2$-CaO-$Al_2O_3$ was found to be liquid below 1400° C within a fairly wide percentage composition range depending upon the range of the amount of $Al_2O_3$ which can be used. The invention in its broadest form includes the process performed with the flux mixture in liquid form with careful control of alkalinity, preferably with a flux composition which is liquid at the lowest temperature. It is illustrated in one modification with a composition range giving a liquid mixture at around 1371° C; however, it is not limited to this composition range and temperature as other mixtures of the basic system which are liquid within other temperature ranges, and particularly low temperature ranges, can be used. The operative temperature range for the purposes of the invention is from about 1250° C to 1600° C. Theoretical calculations indicate that temperature has a large influence on the equilibrium of the reaction $Re_2O_3 + 2Al \rightarrow Al_2O_3 + 2Re$ and that a variation between about 1127° C – 1727° C results in at least an order of magnitude less in recovery of Re from the oxide at the higher temperature. Accordingly, there is a large advantage to be gained recovery-wise by carrying out the reduction at the lowest possible temperature. Experimentation has verified this. The invention is not restricted to the lowest temperature at which the flux mixture is liquid, or to a flux mixture which is liquid at the lowest temperature.

The rare earth metals are the fifteen elements of the lanthanide series having atomic numbers 57–71 inclusive, although the element Yttrium (atomic number 39) is commonly found with and included with the group of metals. In this specification and claims, the term "Rare Earth Metal," or similar terms, includes the mixture of these rare earth metals known as "misch metal," the element Yttrium, and oxides of the various rare earth metals referred to herein includes those discussed and disclosed in U.S. Pat. No. 3,264,093. The metals with which the method of the invention is operative for forming alloys with aluminum and silicon, in addition to the rare earth metals, are metals of Groups 4b, 5b and 6b of the Periodic Table, such as titanium, zirconium, columbium, molybdenum, and tungsten.

The aluminum used may be aluminum metal, particularly cheap scrap metal, or it may be added as a compound. Oxides of aluminum are formed immediately under the reaction conditions, irrespective of the form in which aluminum is added, that is, as a metal or compound. Accordingly, references made herein and in the claims to aluminum oxide in the flux or being added to the flux means the presence of aluminum oxide in the flux through its formation from aluminum added in any form including the oxide itself.

If the alloying metals are added in the form of their carbonates, fluorocarbonates, or silicates, the oxides of the metals are immediately formed under the reaction conditions so that references herein and in the claims to alloying metal oxides in the flux or being added to the flux means the presence of the oxides in the flux by addition as such or through formation in situ from their added compounds.

The operation of the invention will now be illustrated by the following examples, which are not limiting of the invention. The following general procedure was followed for the six examples.

The process may be performed in an electric arc or induction furnace in which the flux is constituted and prefused.

A flux mixture was first made by melting down and fusing a mixture of about 90 weight percent $CaF_2$ and ten weight percent CaO, in an induction furnace using a graphite crucible. To this fused flux blender, a mixture of metal oxide and calcium oxide in a 1:1 ratio was added at a temperature of about 1371° C to render the entire mass fluid.

The final step is the addition of silicon and aluminum metal to the fused mass. The amount of aluminum added is in excess of that theoretically required for reduction of the oxides. The amount of silicon added is in excess of that theoretically required for formation of the silicides from the alloying metal present.

It was found advantageous to first form a flux mixture with about 90 weight percent $CaF_2$ and 10 weight percent CaO rather than using equal amounts of the two, although the invention is not restricted to this ratio as various ratios of the two compounds can be used. It was also found advantageous to add the remainder of the calcium oxide in a 1:1 ratio with the metal oxide. It is preferable to add the silicon and aluminum metal after the mass has become liquid in order to ensure better mixing and a more thorough reaction.

The aluminum metal used was cheap scrap aluminum metal. The amount of aluminum added is controlled within a range to keep the flux mixture liquid at the lowest possible temperature, and its addition is regulated to maintain a low activity of $Al_2O_3$ in the flux as explained above.

The rare earth metal oxides were added in the form of their "misch metal" ore concentrate with the exception of the Yttrium oxide ore of Example Four.

Examples 1, 2 and 3 below were performed in a manner to provide, respectively, low, intermediate and high $Al_2O_3$ content in the flux remaining at the end of the reaction.

EXAMPLE ONE

Mix Used:
Step I - $CaF_2$ - 18 pounds
- CaO - 2 pounds
Step II - ReO - 11 pounds
- CaO - 11 pounds
Step III - Si metal - 4 pounds
- Al scrap - 4.5 pounds Results:
Alloy Weight: 13.5 pounds
Alloy Analysis (weight percent):
Ca - 4.83
Fe - 1.98
Si - 23.83
Al - 15.20
R - 54.14
Flux Analysis (weight percent):
Total CaO + $CaF_2$ as CaO - 71.36
$Al_2O_3$ - 13.78
ReO - 2.00
Re Recovery: 85 Percent

EXAMPLE TWO

Mix Used:
Step I - $CaF_2$ - 16 pounds
- CaO - 8 pounds
Step II - ReO - 27 pounds
- CaO - 9 pounds
Step III - Si metal - 10 pounds
- Al scrap - 10 pounds Results:
Alloy Weight: 32 pounds
Alloy Analysis (weight percent):
Ca - 1.5
Fe - 1.3
Si - 27.4
Al - 11.9
R - 57.6
Flux Analysis (weight percent):
Total CaO + $CaF_2$ as CaO - 63.9
$Al_2O_3$ - 14.8
ReO - 6.4
Re Recovery: 88 Percent

EXAMPLE THREE

Mix Used:
Step I - $CaF_2$ - 20 pounds
- CaO - 10 pounds
Step II - ReO - 34 pounds
- CaO - 1 pound
Step III - Si metal - 9 pounds
- Al scrap - 10 pounds Results:
Alloy Weight: 32 pounds
Alloy Analysis (weight percent):
Ca - 1.9
Fe - 1.1
Si - 21.4
Al - 12.2
R - 60.1
Flux Analysis (weight percent):
Total CaO + $CaF_2$ as CaO - 50.82

-continued $Al_2O_3$ - 22.6
ReO - 4.63
Re Recovery: 72 percent

EXAMPLE FOUR

Mix Used:
Step I - $CaF_2$ - 18 pounds
- CaO - 2 pounds
Step II - $Y_2O_3$ - 12 pounds
- CaO - 11 pounds
Step III - Si metal - 4.0 pounds
- Al scrap - 4.5 pounds Results:
Alloy Weight: 12.0 pounds
Alloy Analysis (weight percent):
Ca - 12.16
Fe - .54
Si - 35.13
Al - 12.98
Y - 40.00
Flux Analysis (weight percent):
Total CaO + $CaF_2$ as CaO - 68.26
$Al_2O_3$ - 14.2
$Y_2O_3$ - 15.1
Y Recovery: 55 Percent

EXAMPLE FIVE

Mix Used:
Step I - $CaF_2$ - 16 pounds
- CaO - 8 pounds
Step 11 - Zirconite Ore - 25 pounds
- CaO - 3 pounds
Step III - Si metal - 3 pounds
- Al scrap - 6 pounds
- Fe powder - 2 pounds Results:
Alloy Weight: 14 pounds
Alloy Analysis (weight percent):
C - .40
Si - 30.78
Fe - 13.42
Ca - 1.34
Zr - 53.62
Al - 2.93
Flux Analysis (weight percent):
$Al_2O_3$ - 21.13
C - .115
$SiO_2$ - 1.18
FeO - 2.00
CaO - 57.32
$ZrO_2$ - 16.50

Note:
Due to volume restrictions of crucible size, all of the aluminum and silicon could not be added as desired. This accounts for the high amount of flux.

EXAMPLE SIX

Mix Used:
Step I - $CaF_2$ - 16 pounds
- CaO - 8 pounds
Step II - 91% Rutile Ore - 28 pounds
- CaO - 6 pounds
Step III - Al - 14 pounds
- Si - 4.5 pounds
- Fe powder - 3.0 pounds Results:
Alloy Weight: 20 pounds
Alloy Analysis (weight percent):
C - .42
Si - 29.18
Fe - 15.22
Ca - 1.16
Ti - 37.67
Al - 13.06
Flux Analysis (weight percent):
$Al_2O_3$ - 32.47
C - .147
$Fe_2O_3$ - 2.23
CaO - 34.0
$TiO_2$ - 32.47

It will be noted from the above results that up to 88 percent of the principal alloying metals were recovered from their ores, and that the resulting alloys had a maximum of about 35% silicon in them. Alloys containing in excess of 50% of the principal alloying metal have been produced. The percentage of aluminum in the alloy does not exceed about 15%, and this is well within permissible limits for a satisfactory alloy. The alloys contain from about 1.00 – 12.00% calcium. The presence of calcium in the alloy is an advantage of the invention because this metal is important for some applications and it is expensive to include calcium in the alloy when it is necessary to purchase it for this purpose.

Operative alloys which can be made by the process of the invention and which are within its scope include alloys having the third metal present in 25–60 weight percent and alloys comprising weight percentages ranges as follows:

| | | | |
|---|---|---|---|
| Nb, Ti or Zr | 25 – 60 | Nb, Ti or Zr | 25 – 60 |
| Al | 1 – 30 | Al | 1 – 30 |
| Si | Remainder | Ca | 1 – 4 |
| Ti | 35 – 60 | Ti | 35 – 60 |
| Al | 5 – 20 | Al | 5 – 20 |
| Si | 15 – 35 | Si | 15 – 35 |
| | | Ca | .5 – 3 |
| Zr | 35 – 60 | Zr | 35 – 60 |
| Al | 1 – 15 | Al | 1 –15 |
| Si | 20 – 35 | Si | 20 – 35 |
| | | Ca | .5 – 4 |

While the invention has been illustrated by its application in which the oxide ores of the alloying metals are added to the flux, it is not limited thereto as the alloying metals may be added in other forms than as oxides, such as carbonates, silicates, and fluorocarbonates from which the oxides are formed in situ under the reaction conditions. The invention is likewise not restricted to use of rare earth metals, titanium and zirconium as the principal alloying metal, as it is applicable to other principal alloying metals, such as, columbium, molybdenum and tungsten. Other alkaline earth metal compounds, such as, those of magnesium, barium and strontium, including their oxides and fluorides, may be used as components of the flux. Other fluorides, such as cryolite, and other alkali metal fluorides, also may be used as components of the flux. Reference made herein and in the claims to the system $CaF_2$-CaO-$Al_2O_3$ or to forming this system includes use of the above equivalents.

Aluminum and silicon may be added either in metal form or as alloys. A suitable silicon addition is either silicon metal or, if iron can be tolerated, ferrosilicon.

It is thus seen that the invention provides an improved method for making alloys of rare earth metals, and other alloying metals, containing aluminum, silicon, and calcium, which has the advantages that cheap scrap aluminum may be substituted for expensive calcium silicide and/or calcium metal as the reducing agent, ores of the principal alloying metals may be used as a source of the metals, and in which a high percentage of the added principal alloying metal is recovered to form an alloy containing a high percentage thereof. The invention further provides an economically advantageous procedure for making the alloys in a suitable flux at low temperatures, and for the necessary step of reducing the activity of $Al_2O_3$ by controlling the alkalinity of the flux.

What is claimed is:

1. A method for making alloys of aluminum and silicon with a third metal selected from the group consisting of rare earth metals and a metal from Groups 4b, 5b and 6b of the Periodic Table which comprises reducing the oxides of the metals with aluminum in the presence of silicon in a flux system comprising an alkali metal or alkaline earth metal fluoride, an alkaline earth metal oxide, and $Al_2O_3$ maintained liquid at a temperature between about 1250° C – 1600° C while maintaining the flux basic to suppress the activity of the $Al_2O_3$ present.

2. The method of claim 1 in which said flux is the system $CaF_2$-CaO-$Al_2O_3$.

3. The method of claim 1 in which aluminum is added within a weight percentage range such that the liquidus temperature of the flux system does not substantially exceed 1400° C.

4. The method of claim 1 performed at a temperature not in excess of 1400° C.

5. The method of claim 1 in which the metals alloying with aluminum and silicon are selected from the group consisting of titanium, zirconium, columbium, and rare earth metals, and mixtures thereof.

6. The method of claim 5 in which the metal alloying with aluminum and silicon is titanium.

7. The method of claim 5 in which the metal alloying with aluminum and silicon is zirconium.

8. The method of claim 5 in which the metal alloying with aluminum and silicon is columbium.

9. The method of claim 5 in which the metal alloying with aluminum and silicon is a rare earth metal.

10. The method of claim 2 in which the metals alloying with aluminum and silicon are selected from the group consisting of titanium, zirconium, columbium, and rare earth metals.

11. The method of claim 10 in which the metal alloying with aluminum and silicon is titanium.

12. The method of claim 10 in which the metal alloying with aluminum and silicon is zirconium.

13. The method of claim 10 in which the metal alloying with aluminum and silicon is columbium.

14. The method of claim 10 in which the metal alloying with aluminum and silicon is a rare earth metal.

15. The method of claim 2 in which aluminum is added within a weight percentage range such that the liquidus temperature of the flux system does not substantially exceed 1400° C.

16. The method of claim 1 in which the flux is maintained basic by adjustment of the alkaline earth metal oxide content thereof.

17. The method of claim 2 in which the flux is maintained basic by adjustment of the calcium oxide content thereof.

18. The method of claim 1 in which the Group 4b, 5b and 6b metals are added in their compounds selected from the group consisting of carbonates, fluorcarbonates, oxides and silicates.

19. The method of claim 1 in which the flux system is maintained liquid within the stated temperature range by regulating the $Al_2O_3$ content thereof.

20. The method of claim 2 in which the flux system is maintained liquid within the stated temperature range by regulating the $Al_2O_3$ content thereof.

21. The method of claim 2 in which the Group 4b, 5b and 6b metals are added in compounds selected from the group consisting of carbonates, fluorocarbonates, oxides and silicates.

22. A method for making an alloy of aluminum and silicon with a third metal selected from the group consisting of rare earth metals and a metal from Groups 4b, 5b and 6b of the Periodic Table which comprises:

(a) making a liquid calcium oxide-calcium fluoride flux;

(b) dissolving in the flux a compound of at least one of said third metals selected from the group consisting of carbonates, fluorocarbonates, oxides and silicates;

(c) adding silicon to the flux mixture;

(d) adding aluminum to the flux mixture in an amount to reduce substantially all of the third metal oxide formed;

(e) maintaining the final flux mixture liquid within a temperature range of about 1250° C - 1600° C by regulating the $Al_2O_3$ content thereof;

(f) maintaining the flux mixture basic to suppress the activity of the $Al_2O_3$ therein by regulating the CaO content thereof; and (f) recovering said alloy.

23. The method of claim 22 in which the aluminum is added within a weight percentage range such that the temperature at which the flux system is liquid does not substantially exceed about 1400° C.

24. The method of claim 22 in which in step (b), part of the calcium oxide is added with the rare earth metal oxide in a one-to-one ratio.

25. The method of claim 22 in which the method is performed at a temperature of between about 1300° C and 1400° C.

26. The method of claim 22 in which the silicon is added with the aluminum.

27. The method of claim 22 in which the aluminum is added at a rate to gradually increase the $Al_2O_3$ content of the flux mixture as the alloy is being formed.

28. A method for making an alloy of aluminum and silicon with a third metal selected from the group consisting of rare earth metals and a metal from Groups 4b, 5b and 6b of the Periodic Table which comprises:

(a) making a flux including the flux system $CaF_2$-CaO-$Al_2O_3$;

(b) incorporating into said flux system an oxide of at least one of said third metals;

(c) adding silicon to said flux system;

(d) adjusting the percentage composition of said flux system to render it liquid within a temperature range of about 1250° C – 1600° C;

(e) maintaining the temperature of the final flux mixture at least up to the melting point thereof within said range a sufficient time for the aluminum to reduce substantially all of the third metal oxide present and to form said alloy; (and)

(f) maintaining said flux system basic by regulating the CaO content thereof, and (g) recovering said alloy.

29. The method of claim 28 in which said flux system is maintained liquid within the stated temperature range by regulating the $Al_2O_3$ content thereof.

30. In the method for making an alloy of aluminum and silicon with a third metal selected from the group consisting of rare earth metals and a metal from Groups 4b, 5b and 6b of the Periodic Table in which the alloys are made by reducing oxides of said third metal with aluminum in the presence of silicon while the reactants are dissolved in the flux system $CaF_2$-CaO-$Al_2O_3$, the improvement which comprises maintaining said flux system liquid at a temperature between about 1250° C – 1600° C and suppressing the activity of the $Al_2O_3$ present by maintaining the flux basic.

31. The improved method of claim 30 in which the flux is maintained basic by regulating the CaO content thereof.

32. The improved method of claim 30 in which the flux system is maintained liquid within the stated temperature range by regulating the $Al_2O_3$ content thereof.

* * * * *